US007438628B2

(12) United States Patent
Kundig

(10) Patent No.: US 7,438,628 B2
(45) Date of Patent: Oct. 21, 2008

(54) DEVICE AND CONTROL UNIT FOR BELT SANDING SYSTEMS

(76) Inventor: Stephan Kundig, Haldenstr. 20, Rapperswil (CH) CH-8640

( * ) Notice: Subject to any disclaimer, the term of this patent is extended or adjusted under 35 U.S.C. 154(b) by 0 days.

(21) Appl. No.: 12/033,491

(22) Filed: Feb. 19, 2008

(65) Prior Publication Data

US 2008/0182491 A1 Jul. 31, 2008

Related U.S. Application Data

(63) Continuation-in-part of application No. 10/569,162, filed on Dec. 1, 2006, now abandoned.

(51) Int. Cl.
*B24B 49/00* (2006.01)

(52) U.S. Cl. ..... 451/9; 451/10; 451/11; 451/300; 451/303

(58) Field of Classification Search ..... 451/8, 451/9, 10, 11, 299, 300, 303
See application file for complete search history.

(56) References Cited

U.S. PATENT DOCUMENTS 3,374,583 A * 3/1968 Jacobi ..... 451/300
3,660,950 A * 5/1972 Takeyama et al. ..... 451/5
3,694,966 A * 10/1972 Heesemann ..... 451/300
3,859,757 A * 1/1975 Heesemann ..... 451/300
3,939,611 A * 2/1976 Hesler et al. ..... 451/1
4,527,359 A * 7/1985 Stump et al. ..... 451/300
4,601,134 A * 7/1986 Hessemann ..... 451/300
4,967,513 A * 11/1990 Hundebol ..... 451/296
2007/0223010 A1 * 9/2007 Weber et al. ..... 356/612

* cited by examiner

*Primary Examiner*—Eileen P. Morgan
(74) *Attorney, Agent, or Firm*—Adams Intellectual Property Law, P.A.

(57) ABSTRACT

A belt sanding system comprising a segmented sanding block including a plurality of individually controllable segments and one or more sanding belt deflecting rollers, a plurality of sensing elements corresponding to the plurality of segments, and a device for interconnecting the plurality of sensing elements, interconnecting the plurality of sensing elements with the segmented sanding block, and effecting lateral movement of the plurality of sensing elements as the segmented sanding block is rotated to an oblique alignment relative to the feed direction.

16 Claims, 7 Drawing Sheets

DEVICE AND CONTROL UNIT FOR BELT SANDING SYSTEMS

CROSS-REFERENCE TO RELATED APPLICATIONS

This application is a Continuation-in-Part Application claiming priority to U.S. patent application Ser. No. 10/569,162 filed Dec. 1, 2006 and entitled "DEVICES FOR ALTERING THE POSITION OF THE SCANNING ELEMENT UNIT ON INCLINED INSTALLATION OF A SEGMENTED GRINDING PLATEN AND CONTROLLER FOR CONTROL THEREOF", which is the National Stage Application claiming priority to PCT/CH04/00509 filed Aug. 16, 2004, which is a PCT application claiming priority to Switzerland Application No. 1437/03 filed Aug. 22, 2003.

TECHNICAL FIELD AND BACKGROUND OF THE INVENTION

1. Field of the Invention

The present invention relates generally to the field of belt sanding systems, and more particularly, to a device for adjusting the position of a sensing element unit in accordance with the inclination or angle of a segmented sanding block, and a control unit for its regulation.

2. Description of the Related Art

A type of throughfeed belt sanding system includes a plurality of sensing elements that work in informational cooperation with a segmented sanding block. The sanding block includes a plurality of individually controllable segmented pads, and a pair of deflecting rollers positioned about either side of the segments around which a sanding belt is guided. As a workpiece is fed through the machine along the feed direction, the surface characteristics of the workpiece are sensed by the sensing elements, and that information is transmitted to the corresponding segmented pads of the sanding block. Thus, the machine includes segmented pads for applying pressure to a workpiece in an individually controllable manner as information is transmitted from the sensing elements.

When the segmented sanding block of the throughfeed sanding machine is set to an inclination with respect to the feed direction of the machine, the problem arises of the loss of alignment of the sensing element series with respect to the different for example perpendicular, positioning of the segmented pads. Since the inclination of the sanding belt alters the position of the segments relative to the sensing elements, the workpiece characteristics are incompletely or incorrectly transmitted to the corresponding segments by the sensing elements, and a discrepancy results leading to improper segmented pad control.

Accordingly, what is desired is a device for adjusting the position of the sensing element series in accordance with the inclination of the segmented sanding block in order to completely and correctly transmit information from the sensing element series to the segmented sanding block.

SUMMARY OF THE INVENTION

To achieve the foregoing and other objects and advantages, and in accordance with the purposes of the invention as embodied and broadly described herein, the present invention provides a device and control unit for a sensing element series of a belt sanding system that adjusts the sensing element series in accordance with the inclination of a corresponding segmented sanding block.

In one embodiment, the present invention provides a belt sanding system device for adjusting the position of a sensing elements series in accordance with the inclination or angle of a corresponding segmented sanding bock, and a control unit for the regulation of the device. The device changes the positioning of the sensing elements series when the segmented sanding block is inclined. The device compensates for arising configuration variations through the lateral translocation of the sensing elements by means of a leverage system, or through the rotation of the sensing element series in parallelogram configuration, The use of segments via the communication of workpiece characteristics by the sensing elements is regulated by the individually programmable electronic control unit.

Additional features and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Figure 1:
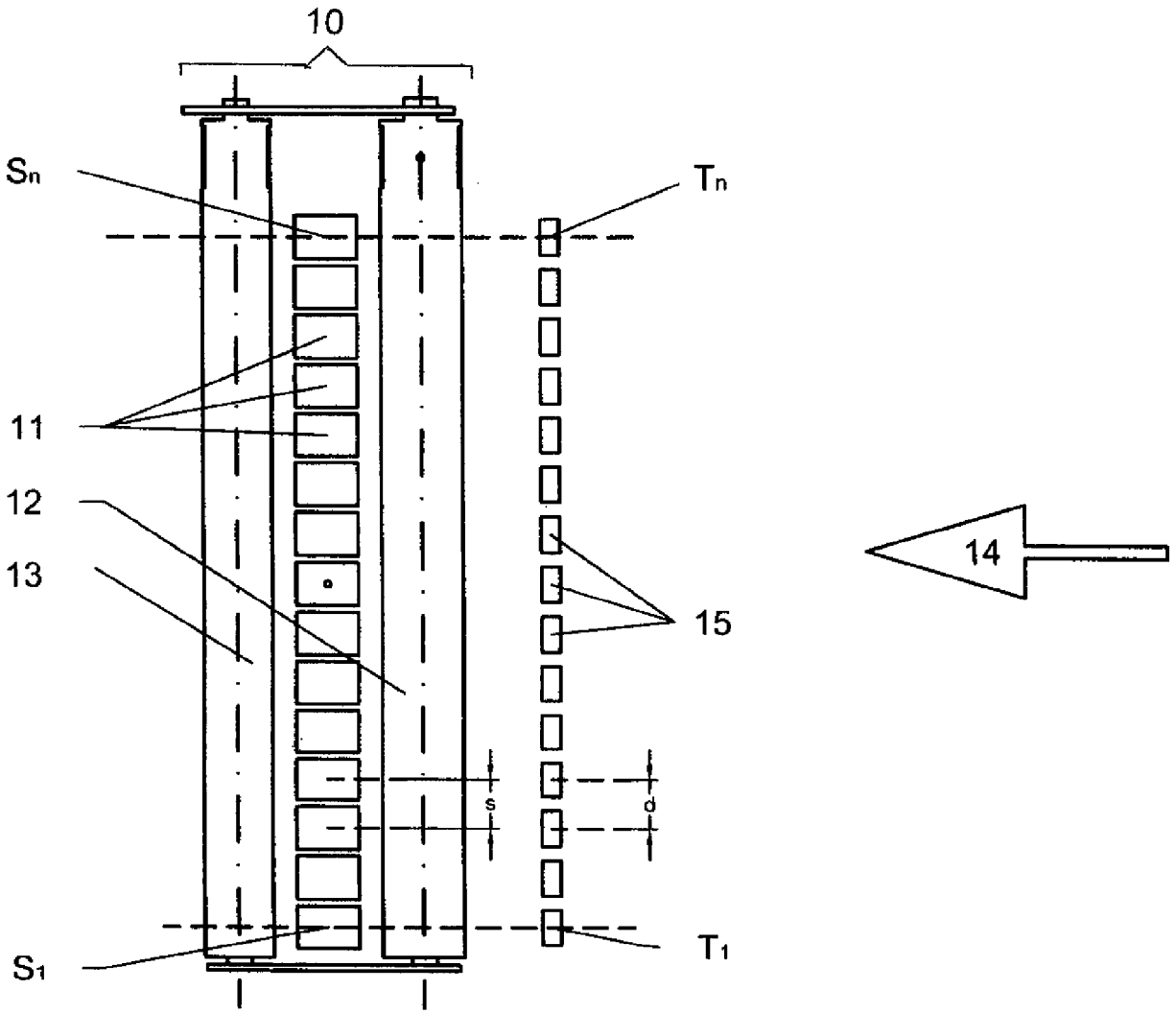
FIG. 1 is a schematic diagram showing the relationship of the sensing element series with respect to the segmented sanding block.

As shown in FIG. 1, specific components of a belt sanding system in accordance with the present invention are shown, while other components have been removed from the drawings to show only the components affected by the device and control unit of the present invention. The belt sanding system has a segmented sanding block 10 including individually controllable, electronic sanding pad segments 11 and sanding belt deflecting rollers 12 and 13 positioned about either side of the segments 11 about which a sanding belt (not shown) is guided. Individual sensing elements 15 make up a sensing elements series and are positioned prior to the sanding block. The segments apply pressure to the belt based on the workpiece surface information transmitted from the sensing elements to a control unit for controlling the segments. As shown, the segmented sanding block and sensing elements series are shown in straight or parallel alignment. A thoroughfare direction is shown at reference numeral 14. d is the distance between the sensing elements 15. s is the distance between the sanding pad segments 11. T1 . . . Tn are selected sensing elements and S1 . . . Sn are the corresponding sanding pad segments, respectively. In other words, as the workpiece is fed along throughfeed direction 14, the surface of the workpiece is sensed by sensing elements 15. Each sensing element 15 corresponds to a sanding pad segment 11 of the segmented sanding pad series, such as Tn and Sn. As the workpiece surface is sensed by sensing element Tn, the surface information is transmitted to the corresponding segment Sn, which is individually controlled for sanding pressure.

Figure 2:
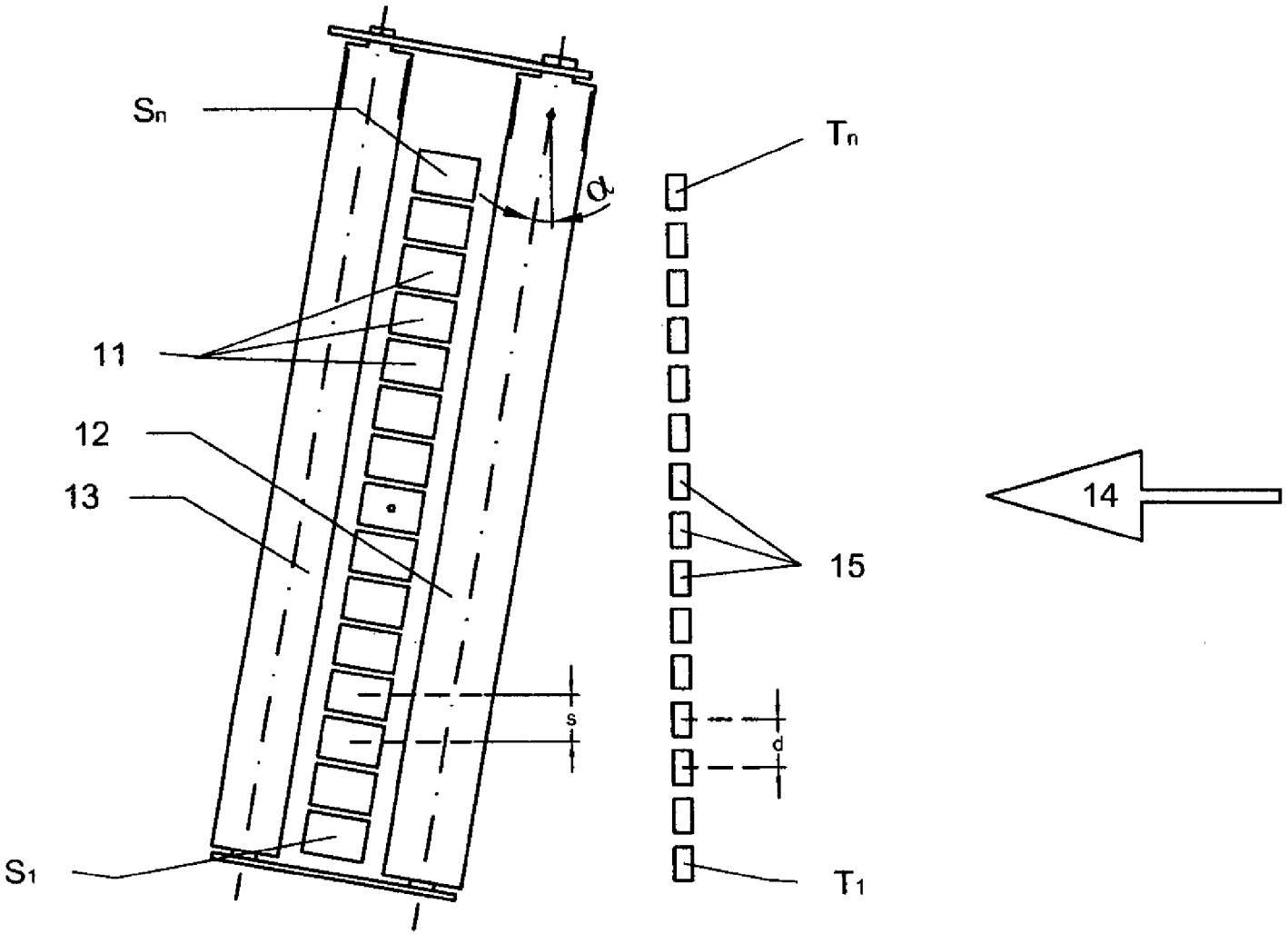
FIG. 2 is a schematic diagram showing the segmented sanding block rotated through angle $\alpha$.

Since FIG. 1 shows the segments 11 and sensing elements 15 in straight alignment, the distance d between the centers of two adjacent sensing elements 15 matches the distance s between the centers of two adjacent segments 11. Sensing element T1 and segment S1, and sensing element Tn and segment Sn, lie along lines parallel to the feed direction. Referring to FIG. 2, when the segmented series rotates or pivots to an angle α relative to the feed direction 14, the distance s reduces relative to the distance d. In addition, T1 and S1, and Tn and Sn, are no longer aligned. This discrepancy has the consequence that the segments 11 in their application no longer match the workpiece characteristics as determined by the sensing elements 15. The device and control unit of the present invention correct this discrepancy.

Figure 3:
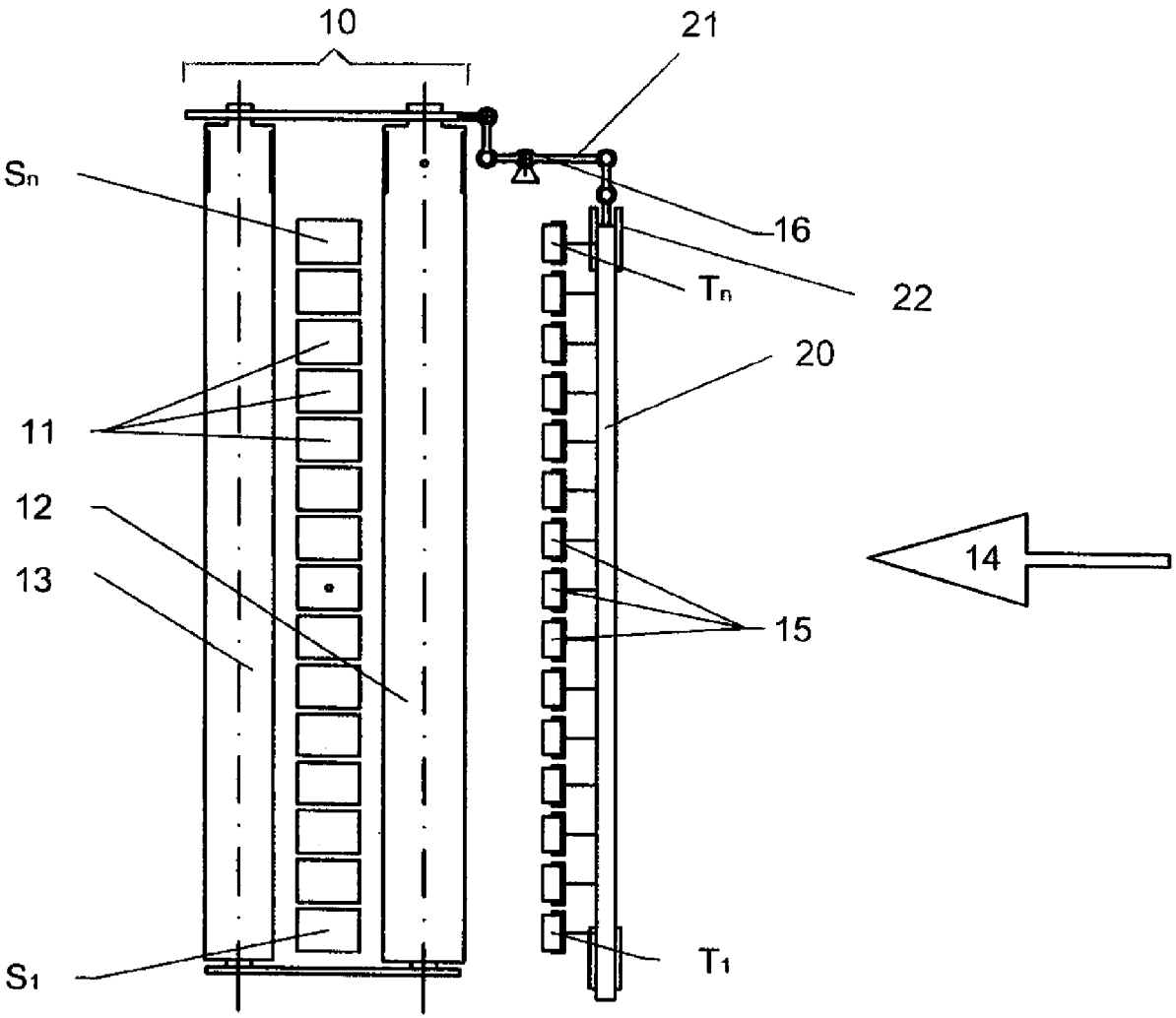
FIG. 3 is a schematic diagram showing a device for effecting a lateral displacement of the sensing element series as the segmented sanding block rotates.
Figure 4:
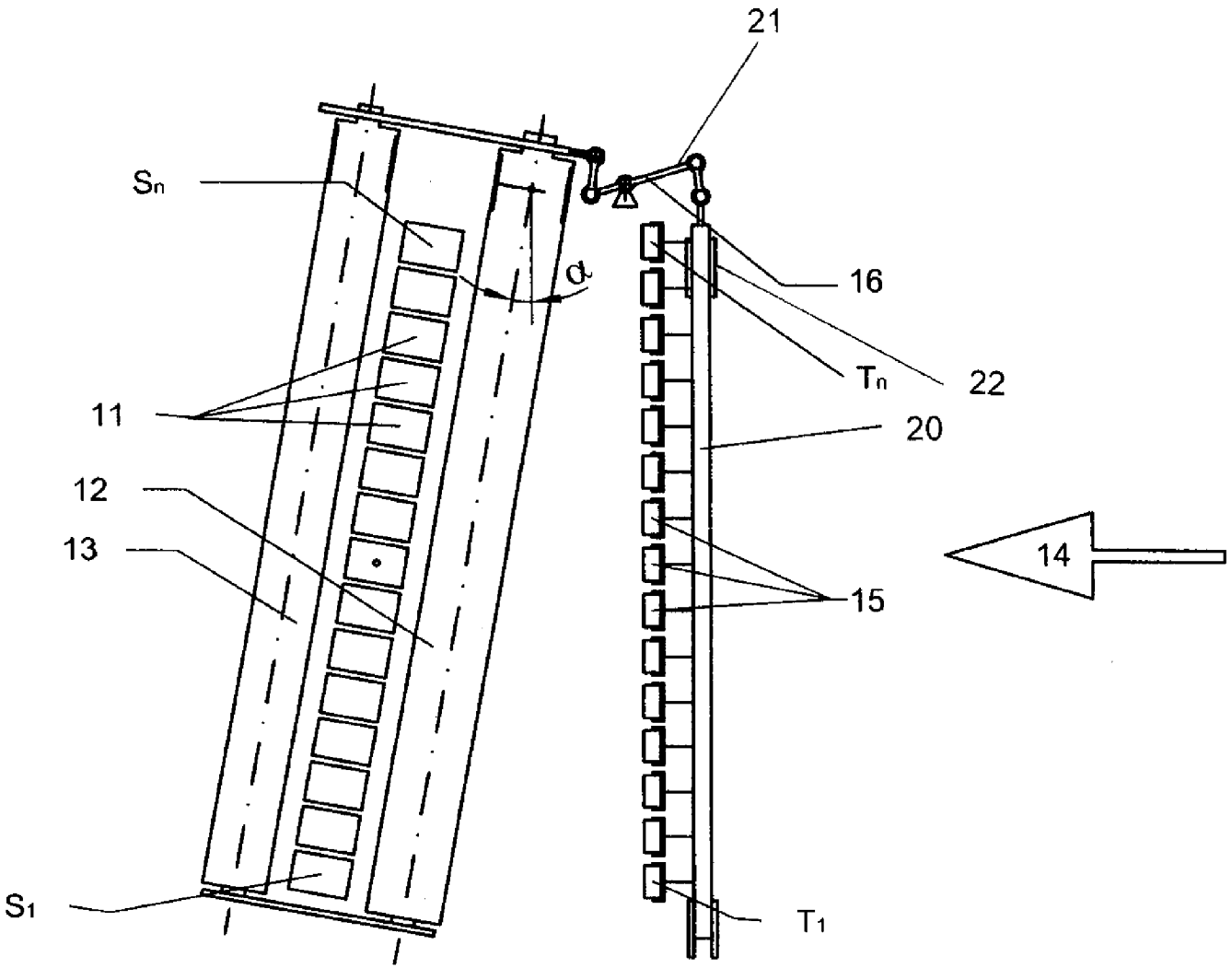
FIG. 4 is a schematic diagram showing the device of FIG. 3 and the segmented sanding block rotated through angle $\alpha$.

Referring to FIGS. 3 and 4, leverage device 16 interconnects the sensing elements 15 and the segmented sanding block, which includes the segments 11 and rollers 12 and 13. FIG. 3 shows the sensing elements 15 and segments 11 in straight alignment. FIG. 4 shows the segments 11 rotated through angle α. The leverage device 16 effects a lateral displacement of the sensing elements 15 when the sanding block 11, 12 and 13 rotates through angle α relative to the feed direction 14. The sanding block is adapted to move steplessly between a perpendicular alignment with the feed direction and any desired oblique alignment with the feed direction. The device 16 includes member 20 for interconnecting each of the sensing elements 15. Member 20 is attached at one end to a lever portion 21 of the device 16 that functions as a lever for effecting the bar laterally as the sanding block is rotated. Member 20 moves laterally within member guides 22. In another embodiment, a servomotor may alternatively be used to effect the lateral displacement. As the sanding block is rotated from straight to the angle shown, the device 16 moves the plurality of sensing elements laterally to the left, substantially eliminating the discrepancy between sensing element and segment alignment. Thus, the leverage device 16 brings sensing elements T1 . . . Tn back into approximate alignment with segments S1 . . . Sn.

Figure 5:
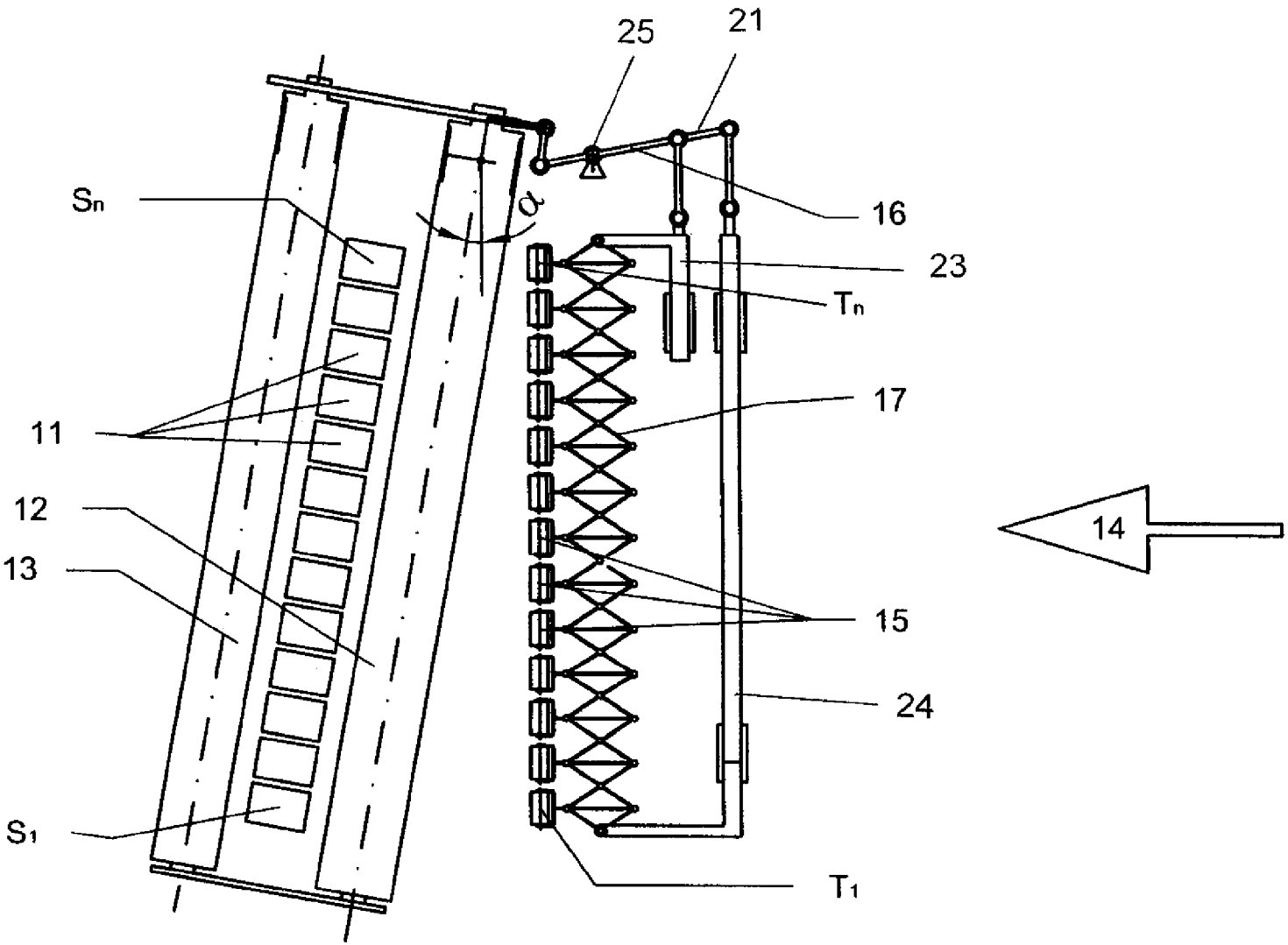
FIG. 5 is a schematic diagram showing the system of FIG. 4 and further including a scissor system for evening out the separation of the sensing elements.

Referring to FIG. 5, if in addition the arising discrepancy in the separation of the segments 15 needs to be accounted for, due to the repositioning of the sensing elements 15, another device 16 including a scissor system 17 may be used. The device 16 is attached about each end of the sensing element series and is adapted to shorten or lengthen the distance d (shown in FIGS. 1 and 2) as needed between sensing elements 15 as the sanding block is rotated through angle α, thus accounting for the discrepancy in the separation of the segments 15. The device 16 and scissor system 17 thus not only effect the lateral movement needed as the sanding block is rotated, but also the distance d between sensing elements. Device 16 includes a first member 23 attached about one end of the sensing element series, and a second member 24 attached about the other end. As the sanding block is rotated, device 16 includes lever portion 21 that moves members 23 and 24 laterally. The amount of lengthening or shortening of d between sensing elements can be controlled by the length of the attachment point of members 23 and 24 from a fulcrum 25 of the lever portion 21.

Figure 6:
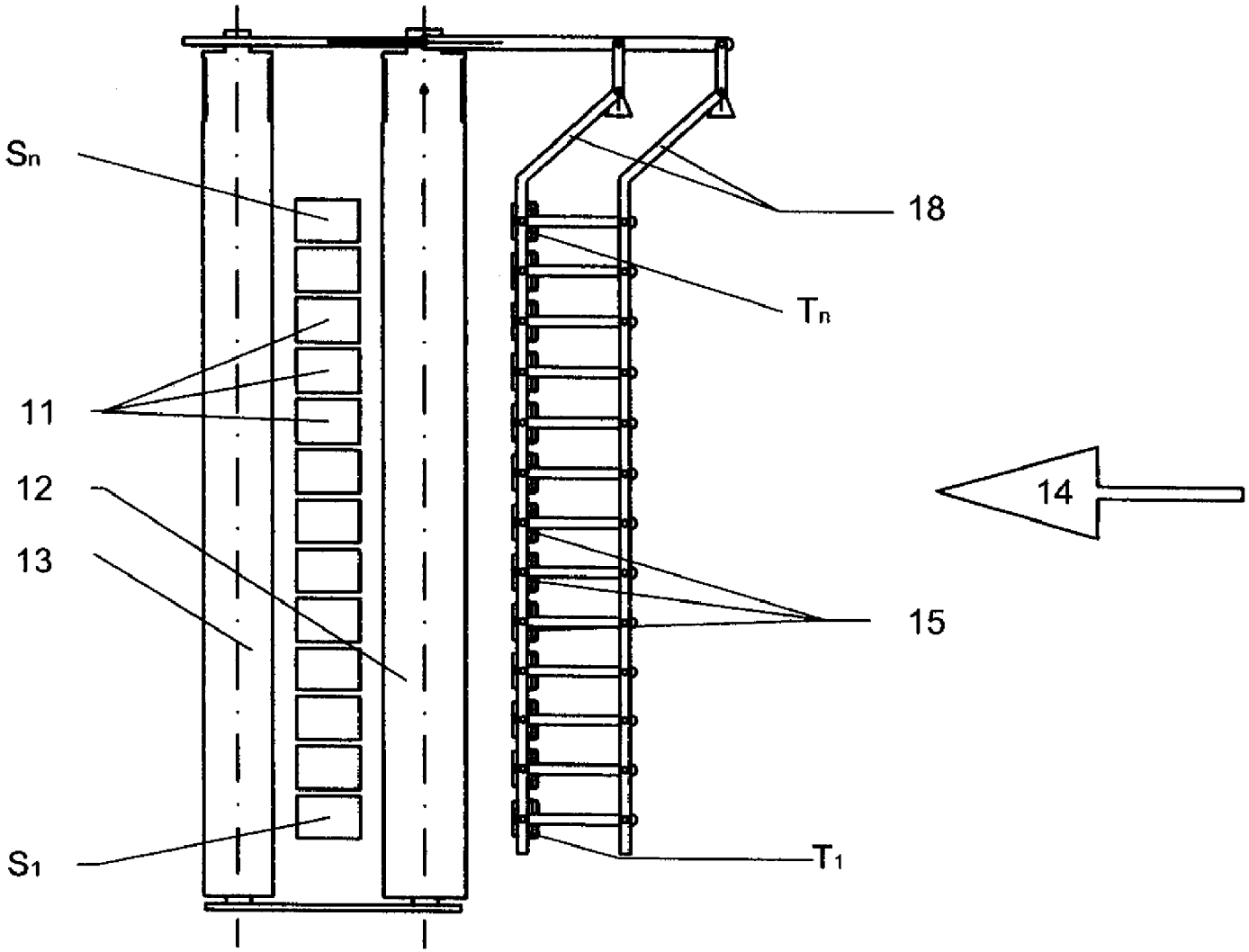
FIG. 6 is a schematic diagram showing the belt sanding system components in a parallelogram configuration.
Figure 7:
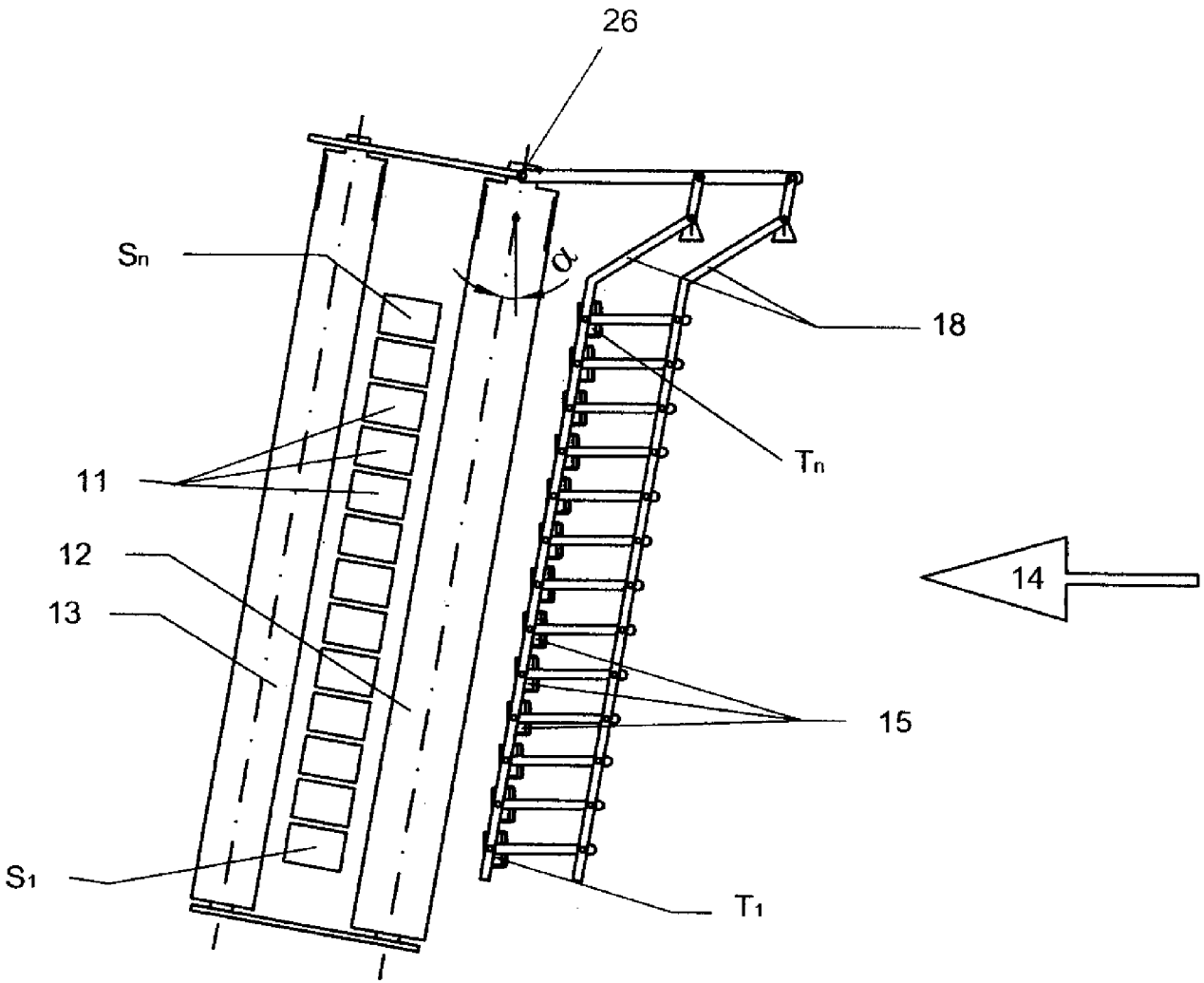
FIG. 7 is a schematic diagram showing the sensing element series and segmented sanding block rotated through angle $\alpha$.

Referring to FIGS. 6 and 7, a belt sanding system in parallelogram configuration is shown in which the sensing elements 15 are moved with and in parallel to the segments 11. FIG. 6 shows the segmented sanding block 11, 12 and 13 and sensing elements 15 in the straight configuration. FIG. 7 shows the segmented sanding block rotated through angle α relative to the feed direction 14. The sensing elements 15 are interconnected through device 18, which attaches about deflecting roller 12 and pivots about fulcrum 26 as the segmented sanding block is rotated through angle α. As the segmented sanding block is rotated, device 18 maintains the sensing elements 15 in their straight configuration while maintaining the distance between each sensing element and its corresponding sanding pad 11. Thus, as the segmented sanding block is rotated, device 18 causes the sensing elements 15 to pivot and maintain their straight forward direction.

For the device shown in FIGS. 3, 4 and 5, due to the varying separation of the individual pairs of sensing elements 15 with their corresponding segments 15, the control system should act specifically for each of the pairs, and not uniformly for all sensing elements 15 and segments 11 in the standard design of straight sanding, as shown in FIGS. 1 and 2, or in the parallelogram configuration as shown in FIGS. 6 and 7. The control of the segments 11 through the workpiece parameters transmitted by the sensing elements 15 is done in the configuration as shown in FIGS. 3, 4 and 5 by means of a specially programmed electronic control unit adapted to substantially diminish the arising discrepancy in the separation of the segments and the sensing elements.

When the segmented sanding block 11, 12 and 13 of the throughfeed sanding machine is set to the angle with respect to the feed direction, the sensing elements 15 remain properly aligned with respect to the positioning of the segments 11. Devices 16 and 18 as well as other alternative devices within the spirit and scope of the present invention compensate for the arising configuration variations through the lateral translocation of the sensing elements by means of the leverage system 16, or through the rotation of the sensing element series in parallelogram configuration 18. The use of the segments 11 via the communication of workpiece characteristics by the sensing elements 15 is regulated by an individually programmable electronic control unit.

The foregoing is a description of various embodiments of the invention that are given here by way of example only. Although the invention has been described with reference to preferred embodiments thereof, other embodiments may perform similar functions and/or achieve similar results. Any and all such equivalent embodiments and examples are within the spirit and scope of the present invention and are intended to be covered by the appended claims.

What is claimed is:

1. A belt sanding system, comprising:

a sanding belt for sanding a workpiece;

a plurality of sensing elements for sensing characteristics of a workpiece;

a segmented sanding block located downstream of the sensing elements including a plurality of individually controllable segments for applying pressure to the standing belt in accordance with the workpiece characteristics sensed by the sensing elements, and one or more sanding belt deflecting rollers, wherein the segmented sanding block is adapted to rotate from perpendicular to an oblique alignment relative to a feed direction of the belt sanding system;

a plurality of sensing elements corresponding to the plurality of segments; and a device for interconnecting the plurality of sensing elements, interconnecting the plurality of sensing elements with the segmented sanding block, and effecting lateral movement of the plurality of sensing elements as the segmented sanding block is rotated to the oblique alignment relative to the feed direction.

2. The belt sanding system in accordance with claim 1, further comprising a control unit for controlling the device.

3. The belt sanding system in accordance with claim 1, wherein the device comprises a member interconnected with a lever that pivots about a fulcrum and is attached to the segmented sanding block, and wherein the member moves laterally when the segmented sanding block is rotated to the oblique alignment.

4. The belt sanding system in accordance with claim 1, wherein the device comprises a first member and a second member attached to a scissor system for interconnecting the plurality of sensing elements, and wherein the first and second members are attached to a lever that pivots about a fulcrum and is attached to the segmented sanding block, and wherein the first and second members move laterally as the segmented sanding block is rotated to the oblique alignment.

5. The belt sanding system in accordance with claim 1, wherein the device moves the sensing elements in parallel with the segments.

6. The belt sanding system in accordance with claim 1, wherein a distance between adjacent ones of the plurality of sensing elements is lengthened or shortened as the segmented sanding block is rotated to the oblique alignment.

7. The belt sanding system in accordance with claim 1, wherein the plurality of sensing elements are moved laterally in accordance with the degree of rotation of the segmented sanding block relative to the feed direction.

8. The belt sanding system in accordance with claim 1, wherein a separation of the sensing elements is adjusted in accordance with a degree of rotation of the segmented sanding block relative to the feed direction.

9. A belt sanding system having a feed direction, comprising:

a sanding belt for sanding a workpiece;

a plurality of sensing elements for sensing characteristics of a workpiece;

a segmented sanding block positioned after the plurality of sensing elements and including a plurality of individually controllable segments for applying pressure to the sanding belt in accordance with the workpiece characteristics sensed by the sensing elements; and a device for interconnecting the plurality of sensing elements with the segmented sanding block such that the position of the plurality of sensing elements is laterally adjusted in accordance with the rotation of the segmented sanding block as the segmented sanding block is rotated to an oblique angle relative to the feed direction.

10. The belt sanding system in accordance with claim 9, further comprising a control unit for controlling the device.

11. The belt sanding system in accordance with claim 9, wherein the device comprises a member interconnected with a lever that pivots about a fulcrum and is attached to the segmented sanding block, and wherein the member moves laterally when the segmented sanding block is rotated to the oblique alignment.

12. The belt sanding system in accordance with claim 9, wherein the device comprises a first member and a second member attached to a scissor system for interconnecting the plurality of sensing elements, and wherein the first and second members are attached to a lever that pivots about a fulcrum and is attached to the segmented sanding block, and wherein the first and second members move laterally as the segmented sanding block is rotated to the oblique alignment.

13. The belt sanding system in accordance with claim 9, wherein the device moves the sensing elements in parallel with the segments.

14. The belt sanding system in accordance with claim 9, wherein a distance between adjacent ones of the plurality of sensing elements is lengthened or shortened as the segmented sanding block is rotated to the oblique alignment.

15. The belt sanding system in accordance with claim 9, wherein the plurality of sensing elements are moved laterally in accordance with the degree of rotation of the segmented sanding block relative to the feed direction.

16. The belt sanding system in accordance with claim 9, wherein a separation of the sensing elements is adjusted in accordance with a degree of rotation of the segmented sanding block relative to the feed direction.

* * * * *